United States Patent [19]

Batiuk

[11] 4,451,304

[45] May 29, 1984

[54] METHOD OF IMPROVING THE CORROSION RESISTANCE OF CHEMICAL CONVERSION COATED ALUMINUM

[76] Inventor: Walter Batiuk, 8247 Ashworth N., Seattle, Wash. 98105

[21] Appl. No.: 477,420

[22] Filed: Mar. 21, 1983

Related U.S. Application Data

[63] Continuation of Ser. No. 260,370, May 4, 1981, abandoned.

[51] Int. Cl.[3] ..... C23C 1/08; C23F 7/00

[52] U.S. Cl. ..... 148/6.27; 148/6.2

[58] Field of Search ..... 427/309, 327, 372.2, 427/383.3, 444; 156/665; 148/6.27, 6.2; 106/14.05, 15.05, 18.36; 134/2, 3, 41; 252/81, 142, 146

[56] References Cited

U.S. PATENT DOCUMENTS

| | | | |
|---|---|---|---|
| 2,351,465 | 6/1944 | Wachter | 106/14.21 |
| 2,671,717 | 3/1954 | Ferguson | 156/665 |
| 2,883,311 | 4/1959 | Halpert | 156/665 |
| 3,140,203 | 7/1964 | Grunwald | 156/665 |
| 3,335,096 | 8/1967 | Hatch | 252/387 |
| 3,340,001 | 9/1967 | Thornhill | 252/389 R |
| 3,433,577 | 3/1969 | Shick | 106/14.05 |
| 3,445,400 | 5/1969 | Everhart | 252/175 |
| 3,728,188 | 4/1973 | Yarrington | 156/665 |
| 3,802,973 | 4/1974 | Smith | 156/665 |
| 3,849,208 | 11/1974 | Marosi | 427/309 |
| 4,087,367 | 5/1978 | Rioult et al. | 427/309 |

*Primary Examiner*—Sadie L. Childs

[57] ABSTRACT

A method for treating aluminum prior to applying a chemical conversion coating for improving its corrosion resistance especially when rigid requirements need to be met. The aluminum is alkaline cleaned and deoxidized, preferably with a non-chromated deoxidizer. A supplementary treatment consists of immersing the deoxidized aluminum in a potassium of sodium nitrite solution. The aluminum is then coated with a standard chemical conversion coating, and dried at a temperature between 110° F. and 130° F. The resulting product is able to pass salt spray test requirements as outlined in the military specification.

11 Claims, No Drawings

METHOD OF IMPROVING THE CORROSION RESISTANCE OF CHEMICAL CONVERSION COATED ALUMINUM

CROSS REFERENCE TO RELATED APPLICATIONS

This application is a continuation of my co-pending application, Ser. No. 260,370, abandoned, filed May 4, 1981.

BACKGROUND OF THE INVENTION

1. Field of the Invention

This invention relates in general to improving the corrosion resistance of chemical conversion coated aluminum, and more specifically to a method for treating deoxidized aluminum prior to conversion coating which improves the ability of the aluminum to pass rigid corrosion resistance requirements.

2. Discussion of the Prior Art

Conversion coated aluminum has been used by airframe and other manufacturers, including the military, to improve aluminum's corrosion resistance and paint adhesion properties. In the prior art, the aluminum is deoxidized using a chromated deoxidizer, and then coated in the conversion process with a coating resistant to corrosion. When coated aluminum is manufactured for use in military applications, a stringent corrosion resistant test must be met as outlined in Military Specifications No. MIL-C-5541 and MIL-C-81706. These tests require subjecting the finished aluminum product to a salt spray for a lengthy period of time, such as 164 and 328 hours, respectively.

Prior to the present invention, it was extremely difficult to pass the salt spray requirement imposed by the military for aluminum hardware. Special conversion coatings were developed, and various deoxidizers used. In general, the aluminum was treated using a chromated deoxidizer to etch away the natural and heat-treat oxide so that the finished product has a uniform color and texture. A chemical conversion coating is applied to the aluminum. One typical coating is "Alodine 1200S" manufactured by the Amchem Products, Inc., Ambler, Pa. This conversion coating consists of a corrosion resistant brown iridescent layer. This film has potentially good resistance to normal corrosion; however, in highly corrosive environments such as that required by the salt spray test, the film may succumb to corrosion and not meet military specifications. In general, the prior art relied upon chromated deoxidizers to meet the stringent corrosion requirement tests. Non-chromated deoxidizers were tested, but failed to meet the military specification requirements after being chemically conversion coated. Deoxidizers containing the chromate ion, although producing better results in salt spray test requirements, have a pollution problem due to the effluent stream. Heavy metals, such as chrome, are highly toxic to the environment, and are therefore undesirable for release into closed or open bodies of water. Previous to the present invention, a workable non-chromated treatment process prior to chemical conversion coating aluminum was lacking if salt spray requirements were to be consistently met.

A search of the prior art disclosed the following patents to be of potential interest:

| U.S. Pat. No. | Inventor | Issue Date |
|---|---|---|
| 3,802,973 | Smith | 4/9/74 |
| 3,510,430 | Bland et al | 5/5/70 |
| 3,445,400 | Everhart | 5/20/69 |
| 3,443,577 | Shick | 3/18/69 |
| 3,340,001 | Thornhill | 9/5/67 |
| 3,335,096 | Hatch | 8/8/67 |
| 3,275,562 | Smith | 9/27/66 |
| 3,140,203 | Grunwald | 6/7/64 |
| 2,883,311 | Hulpert | 4/21/59 |
| 2,671,717 | Ferguson | 3/9/54 |
| 2,351,465 | Wachter | 6/13/44 |

None of these patents singularly or in combination anticipate the present invention. Taking each of the above individually, U.S. Pat. No. 2,351,465 issued to Wachter deals with the use of sodium nitrite as an inhibitor to corrosion inside steel pipelines carrying petroleum distillates. This invention specifically needed to protect the pipelines from distillates containing hydrocarbon oils; and not salt spray as the present invention. Hulpert, in U.S. Pat. No. 2,883,371 teaches a chromated deoxidizer which the present invention would eliminate as a pollution problem. A non-chromated aluminum deoxidizer is disclosed in U.S. Pat. No. 3,140,203 issued to Grunwald; however, this patent does not teach the applicability and compatibility of this deoxidizer with a conversion coating. U.S. Pat. No. 3,275,562, issued to Smith, shows one formulation of a non-chromated aluminum desmutter, and does not teach the method of the present invention. As in the previously cited patent, Thornhill (U.S. Pat. No. 3,340,001) teaches a composition for protecting metal from corrosion which is constantly in contact with the metal. This composition contains sodium nitrite; however, it is not obvious from Thornhill that this composition would have good results when combined with chemical conversion coating. Shick, in U.S. Pat. No. 3,433,577, uses a composition containing sodium nitrite for protecting metal parts from corrosion. The purpose of this composition is for vapor phase corrosion inhibitors during storage, and does not anticipate or is applicable to the present invention. U.S. Pat. No. 3,445,400 issued to Everhart contains a chromated formulation which the present invention seeks to avoid. Bland et al., in U.S. Pat. No. 3,510,430 disclosed a ferric sulfate non-chromated deoxidizer which would not satisfactorily meet salt spray tests. The nitrites in this formulation are used to prevent pitting during deoxidization which is different from the function in the present invention. U.S. Pat. No. 3,802,973 teaches an oxidizing agent to uniformly etch aluminum in an alkaline solution for the purpose of hiding surface defects, and does not directly relate to the present invention. Harris et al., in U.S. published patent application No. B265,369 published 1/28/75, shows a metal exposed continuously to a rust inhibitor as others in the search have shown, and again does not anticipate the present invention.

Ferguson (U.S. Pat. No. 2,671,717) teaches brightening of aluminum using sodium nitrite. His invention is concerned with balancing the effect of the sodium or potassium hydroxide etching quality with the slight oxidation (pacification) produced by the nitrite and/or nitrate ion. This balancing occurs in a highly alkaline solution (pH in the area of 14), and produces an aluminum surface with a dark, thick coating called "smut" which is then removed with acid, and followed by an anodizing step if desired to maintain maximum specularity. This process achieves the desired uniform brightness and aesthetic effect. If Ferguson would apply a chemical conversion coating to his treated aluminum instead of his subsequent anodic step, his aluminum would fail to meet the MIL-C-5541 salt-spray requirements.

Furthermore and particularly important, is that Ferguson must have the hydroxide ion present in a significant concentration (pH around 14). The present invention requires an acid solution (pH less than 5) to produce desired results with no hydroxide ions present.

The Hatch patent (U.S. Pat. No. 3,335,096) discloses a solution containing sodium nitrite with a silicofluoride. Hatch discloses that sodium nitrite-sodium tetraborate-benzotriazole compositions have been used as corrosion inhibitors for years in closed cooling water systems such as in deisel engines. These compositions have given good protection for ferrous metals, copper and copper alloys, but according to Hatch, they actually accelerate the corrosion of aluminum. Hatch discovered that a silicofluoride is needed as an additive to this solution to improve corrosion resistance with respect to aluminum. The present invention does not use and has no need for a silicofluoride or any fluoride ion in his nitrite solution. Furthermore, it should be noted that Hatch, like Ferguson, calls for an alkaline environment (pH 7 to 9). This alkaline pH condition is not compatible with the present invention using an acid pH (less than pH 5).

In addition to the above cited art, the following patents appear to be of interest: U.S. Pat. No. 3,728,188 issued to Yarrington and U.S. Pat. No. 3,849,208 issued to Marosi. Regarding Yarrington, it should be pointed out that his chrome free deoxidizing method does not teach the use of a post deoxidizing nitrite treatment. Numerous examples in the following specification show that chrome-free deoxidizing alone, without the use of a post treatment nitrite ion solution of the present invention, would fail salt spray requirements of the military specifications. Marosi, similar to Ferguson, uses an alkaline etch and an acid desmutter. Marosi does not use the nitrite ion in a post deoxidizing step as does the present invention.

SUMMARY OF THE INVENTION

The present invention discloses a method for treating aluminum metal to enhance corrosion resistance, and especially to meet salt spray test requirements imposed by the military. The method includes deoxidizing the aluminum with deoxidizing means, rinsing the aluminum and exposing the aluminum to a sodium nitrite solution with a pH lower than 5. The aluminum is then rinsed and coated with a chemical conversion coating such as "Alodine 1200S" and dried by suitable drying means such as warm air. The present invention teaches that the sodium nitrite treatment is especially effective if that solution is maintained at a pH between 3 and 4. Further, it is preferable to use a deoxidizing solution of 25% to 50% nitric acid. Drying temperatures in the range of 110° F. and 130° F. give the best results.

It is, therefore, the object of the present invention to provide a method for treating aluminum which uses a non-chromated deoxidizer and a chemical conversion coating with the final product able to withstand the salt spray requirements of the military specification.

Another object of the present invention is to provide a method for treating aluminum which eliminates an effluent stream containing chromate.

A further object of the present invention is to allow aluminum to be conversion coated without the use of a chromated deoxidizer.

These and other objects and advantages will become more apparent from the following detailed description of the invention, including tables and examples.

DETAILED DESCRIPTION OF THE PREFERRED EMBODIMENT

The present invention may be practiced on the following sequence of operation:

(1) vapor degreasing the aluminum;
(2) alkaline cleaning the aluminum;
(3) rinsing the aluminum with water;
(4) deoxidizing the aluminum, preferably with a non-chromated deoxidizer;
(5) rinsing the deoxidized aluminum with water;
(6) exposing the aluminum to a sodium nitrite solution;
(7) rinsing the aluminum with water;
(8) chemical conversion coating the aluminum; and
(9) drying the aluminum.

Vapor degreasing of the aluminum metal can be performed by standard techniques known to one skilled in the art. Similarly, alkaline cleaning and rinsing of the aluminum are steps commonly known to those skilled in the art and insure a clean aluminum surface prior to deoxidization.

The deoxidization step which is the next step is preferably produced with a non-chromated deoxidizer. A chromated deoxidizer is undesirable from a pollution standpoint since chrome or chrome ions are toxic, and the effluent stream may be released to open bodies of water. The invention can be practiced, however, using a chromated deoxidizer if desired and the resulting product will readily meet the salt spray requirements of the military. A non-chromated deoxidizer that can be used for beneficial results, by way of example, is a nitric acid solution containing the fluoride ion. In the preferred embodiment of the invention, the fluoride ion would be present in the deoxidizing solution in an adequate and normally practical amount to obtain an etch rate of the aluminum surface of up to approximately 0.6 mils/side/hr. The fluoride ion could be obtained from hydrofluoric acid or any suitable salt containing the ion. Nitric acid can typically be used in a concentration of 25% to 50% $HNO_3$ to inhibit the redisposition of copper, commonly called "smut."

The fluoride ion is preferred since it is one of the best etching agents of unfinished aluminum metal, and can etch uniformly without pitting. To supplement the etching action of the fluoride ion, nitric acid is used to remove undissolved silicon from the aluminum surface and prevent the formation of smut. Other non-chromated deoxidizers may be used in the practice of the invention without losing the beneficial effects of treating aluminum in the manner taught by the inventor. The aluminum may be immersed in the deoxidizer for approximately 5 minutes to 60 minutes or greater, depending on the difficulty of scale removal. The nitric acid deoxidizer performs best when a freshly prepared solution is buffered with some dissolved metallic aluminum.

After deoxidization, the aluminum is then rinsed with cold water, and a supplemental treatment, differing from the prior art, is performed to allow the final conversion coated product to pass salt spray requirements. In this step, the deoxidized aluminum is rinsed with a sodium nitrite solution. The aluminum may either be immersed in the solution or sprayed with the solution. The sodium nitrite solution is maintained at a pH less than 5 and preferably at pH 3 or below. Nitric acid can supply the necessary hydrogen ion concentration. The concentration of sodium nitrite is not critical, assuming the pH is less than 5, and beneficial results can be obtained with a sodium nitrite solution of 1%. After the sodium nitrite treatment, a water rinse of the aluminum is performed prior to chemical conversion coating. It should also be noted that potassium nitrite may be used in place of sodium nitrite with beneficial results.

The chemical conversion coating can be done with any of the coating solutions known to the prior art. It has been found that Alodine 1200S, manufactured by Amchem Products, Inc., Ambler, Pa., works satisfactorily.

Alodine 1200S is comprised of the following compounds: Chromic Acid—54% by weight; Potassium Fluoroborate—22% by weight; Potassium Flurozirconate—2% by weight; Sodium Fluoride—6% by weight; and Potassium Ferricynide—16% by weight. This formulation is well known to the art for many years prior to the present invention. The method of manufacture of Alodine 1200S was known prior to applicant's invention and is contained in U.S. Pat. Nos. 2,796,370 and 2,796,371 issued to Ostrander et al., dated June 18, 1957.

To coat the aluminum, immersion in the coating solution is allowed to take place for a relatively short time such as up to five minutes.

After conversion coating, the aluminum is dried by warm air. In the preferred embodiment of the invention, the drying temperature will be in the range of 100° F. to 130° F. with an optimum at 120° F. The present invention may be further understood by reference to the following examples and accompany tables.

EXAMPLE 1

Bare aluminum alloy specimens (10" by 3") were used in this and all other examples. Table 1 shows the results of this series of samples which illustrates the effect of sodium nitrite treatment on the salt spray test results. A partially depleted chromate-type deoxidizer was used called Am Chem 6-17, a product of Amchem Products, Inc., Ambler, Pa. As in all examples, each specimen was first cleaned using an alkaline cleaner called Turco 2623, a product of the Turco Products Division of Purex Corporation Ltd., Wilmington, Calif. The alkaline cleaning was conducted for 30 minutes at 140° F. Deoxidation occurred in Amchem 6-17 with the etch rate adjusted to 0.25 mils/side/hr with hydrogen fluoride. The next processing step for the bottom four specimens on Table 1 was an immersion in the sodium nitrite solution for 30 minutes. The solution had a pH of 3 and a concentration of 3%. The top four specimens did not receive a sodium nitrite immersion. All specimens were then immersed in Alodine 1200S and dried for 30 minutes at a temperature of 110°-130° F. It should be noted that all specimens in all examples were rinsed with tap water after each processing step. Table 1 shows that only the specimens which were immersed in the sodium nitrite solution passed the salt spray test, i.e. the top four specimens of Table 1 had one or more corrosion pits visible to the unaided eye, indicating failure, while the bottom four specimens had no visible corrosion pits, indicating passing results.

In this example, as in all other examples, the tests were concluded after one week of salt spray immersion for visual examination and other evaluation tests.

EXAMPLE 2

Bare alloy specimens similar to those used in Example 1 were used in Example 2. The main difference in the two examples was the use of a non-chromated ferrous ion-type deoxidizer instead of a chromated deoxidizer. The deoxidizer in this example was Isoprep 184, a product of Allied-Kelite Products Division, Los Angeles, Calif. It was used in a 25% concentration with an etch rate of 0.25 mils/side/hr. maintained with hydrogen fluoride addition. The sodium nitrite solution was 2.3% sodium nitrite with a pH of 3.0. This example illustrates that the only specimens which passed the salt spray test (no pits visible to the unaided eye) were those immersed in the sodium nitrite solution.

EXAMPLE 3

Example 3 is similar to Examples 1 and 2, differing only in the deoxidizer used. In Example 3, a nitric acid-fluoride ion type non-chromate deoxidizer was used. The specimens were processed in the same manner as Examples 1 and 2. The deoxidizer consisted of 40% by volume of concentrated nitric acid (technical grade) with a sufficient fluoride ion concentration to produce an etch rate of 0.25 mils/side/hr. The sodium nitrite solution was of a 2.3% concentration with a pH of 3.3. The results outlined in the table show that the specimens passing the salt spray test were those which were immersed in sodium nitrite. The specimens which were not immersed in the sodium nitrite solution failed the test.

EXAMPLE 4

In Example 4, a nitric acid-fluoride ion type non-chromated deoxidizer was used as in Example 3. Instead of immersion in a sodium nitrite solution after this processing step, a potassium nitrite solution of 2.3% concentration with a 3.0 pH was used. The results show that the specimens which were not immersed in the potassium nitrite solution failed to pass the salt spray test. The specimens that were immersed in potassium nitrite, however, passed the salt spray test.

EXAMPLE 5

Example 5 uses Isoprep 184, a ferrous ion-type non-chromated deoxidizer as did Example 2. Instead of sodium nitrite, potassium nitrite was used in the next processing step. The solution was of 2.3% concentration with a pH of 3.0. As seen in Table 5, the only specimens passed were those treated with potassium nitrite.

EXAMPLE 6

Bare aluminum 2024-T3 panels were processed in a conversion coating line, using a chromated deoxidizer and a conversion coating solution of Alodine 1200S. Immersion time in the Alodine 1200S varied slightly between 2½ and 3 minutes. All of the panels after drying were aged for 3 days prior to salt spray testing for 336 hours. Drying temperatures were varied from ambient temperature to 160° F. The results are summarized in Table 6. The panels dried at 120° F. suffered no corrosion damage, and no detectable change was evident in color of the panels or surface finish. After the 336 hour salt spray test, the panels were resubjected to salt spray until failure. Three of the four panels dried at 120° F. exceeded five weeks of salt spray when the tests were suspended. The panels dried at 140° F. failed in one week, which is typical of the results obtained prior to discovering the critical temperature factor. The panels dried at 100° F. had marginal resistance to corrosion, while those dried at 70° F.–75° F. failed the test in a random pattern, perhaps due to insufficient time necessary for conditioning the Alodine 1200S coating at lower temperatures.

TABLE 1

| | | Amchem 6–17, Chromate-type Deoxidizer Without and With Sodium Nitrite Treatment | | | | |
|---|---|---|---|---|---|---|
| Specimen No. and Alloy | Alkaline Cleaned | Deoxidized in Amchem 6–17 (Minutes) | Immersion in Sodium Nitrite Solution (Minutes) | Alodine 1200S Immersion Time (Minutes) | Dried | Mil-C-5541B Salt Spray Test Results |
| 5401-2024T/3 | Yes | 30 | — | 1.5 | Yes | Failed, less than 1 week |
| 5402-2024T/3 | " | " | — | " | " | " |
| 5401-7075T/6 | " | " | — | " | " | " |
| 5402-7075T/6 | " | " | — | " | " | " |
| 54018-2024T/3 | Yes | 30 | 30 | 2.0 | Yes | Passed, greater than 1 week |
| 54019-2024T/3 | " | " | " | " | " | " |
| 54018-7075T/6 | " | " | " | " | " | " |
| 54019-7075T/6 | " | " | " | " | " | " |

TABLE 2

| | | Isoprep 184, Ferrous ion-type Non-chromate Deoxidizer Without and With Sodium Nitrite Treatment | | | | |
|---|---|---|---|---|---|---|
| Specimen No. and Alloy | Alkaline Cleaned | Deoxidized in Isoprep 184 (Minutes) | Immersion in NaNO2 Solution (Minutes) | Alodine 1200S (Minutes) | Dried | Mil-C-5541B Salt Spray Test Results |
| 221033-2024T/3 | Yes | 30 | — | 2 | Yes | Failed, less than 1 week |
| 221034-2024T/3 | " | " | — | 2 | " | " |
| 221042-2024T/3 | Yes | 30 | 14 | 2 | – | Passed, greater than 1 week |
| 221043-2024T/3 | " | " | 14 | 2 | " | " |

TABLE 3

| | | Nitric Acid, Fluoride ion-type Non-chromate Deoxidizer Without and with Sodium Nitrite Treatment | | | | |
|---|---|---|---|---|---|---|
| Specimen No. and Alloy | Alkaline Cleaned | Deoxidized in HNO3—HF (Minutes) | Immersion in NaNO2 Solution (Minutes) | Alodine 1200S (Minutes) | Dried | Mil-C-5541B Salt Spray Test Results |
| 120591-2024T/3 | Yes | 10 | — | 3 | Yes | Failed, 1 week |
| 120591-7075T/6 | " | 10 | — | 3 | " | " |
| 54016-2024T/3 | Yes | 30 | 30 | 2 | " | Passed, 1 week |
| 54017-2024T/3 | " | 30 | 30 | 2 | " | " |
| 54027-2024T/3 | " | 25 | 25 | 2 | " | " |
| 54028-2024T/3 | " | 25 | 25 | 2 | " | " |
| 54016-7075T/6 | " | 30 | 30 | 2 | " | " |
| 54017-7075T/6 | " | 30 | 30 | 2 | " | " |

TABLE 4

| | | Nitric Acid, Fluoride ion Type Non-chromate Deoxidizer Without and With Potassium Nitrite Treatment | | | | |
|---|---|---|---|---|---|---|
| Specimen No. and Alloy | Alkaline Cleaned | Deoxidized in HNO3—AF (Minutes) | Immersion in KNO2 Solution (Minutes) | Alodine 1200S (Minutes) | Dried | Mil-C-5541B Salt Spray Test Results |
| 120591-2024T/3 | Yes | 10 | — | 3 | Yes | Failed, 1 week |
| 120591-7075T/6 | " | 10 | —3 | "" | | |
| 54025-2024T/3 | Yes | 20 | 30 | 2 | Yes | Passed, 1 week |
| 54026-2024T/3 | " | 20 | 30 | 2 | " | " |

TABLE 5

| | | Isoprep 184, Ferrous ion-Type Non-Chromate Deoxidizer Without and With Potassium Nitrite Treatment | | | | |
|---|---|---|---|---|---|---|
| Specimen No. and Alloy | Alkaline Cleaned | Deoxidized in Isoprep 184 (Minutes) | Immersion in KNO2 Solution (Minutes) | Alodine 1200S (Minutes) | Dried | Mil-C-5541B Salt Spray Test Results |
| 221033-2024T/3 | x | 30 | — | 2 | x | Failed, 1 week |

TABLE 5-continued

| Specimen No. and Alloy | Alkaline Cleaned | Deoxidized in Isoprep 184 (Minutes) | Immersion in KNO2 Solution (Minutes) | Alodine 1200S (Minutes) | Dried | Mil-C-5541B Salt Spray Test Results |
|---|---|---|---|---|---|---|
| | Isoprep 184, Ferrous ion-Type Non-Chromate Deoxidizer Without and With Potassium Nitrite Treatment | | | | | |
| 221034-2024T/3 | x | 30 | — | 2 | x | " |
| 221036-2024T/3 | x | 30+ | 15 | 1.5 | x | Passed, 1 week |
| 221037-2024T/3 | x | " | 15 | 1.5 | x | " |
| 221038-2024T/3 | x | " | 15 | 1.5 | x | " |
| 221031-7075T/6 | x | " | 15 | 1.5 | x | " |
| 204032-7075T/6 | x | " | 15 | 1.5 | x | " |
| 204033-7075T/6 | x | " | 15 | 1.5 | x | " |

TABLE 6

| Panel No. | Alodine Immersion Time, Min. | Drying Temperature | Drying Time, Min. | Salt Spray Result* |
|---|---|---|---|---|
| | Drying Temperature Effect on Alodined 1200D Aluminum Panels | | | |
| 899 | 2½ | Ambient | 30 | Failed, 2 weeks |
| 900 | 2½ | (70–75) | 30 | Passed, 5 weeks |
| 901 | 2½ | (70–75) | 30 | Failed, 2 weeks |
| 902 | 2½ | (70–75) | 30 | Passed, 6 weeks |
| 914 | 3 | 100 | 30 | Marginal** |
| 915 | 3 | 100 | 30 | " |
| 916 | 3 | 100 | 30 | " |
| 917 | 3 | 100 | 30 | " |
| 910 | 3 | 120 | 30 | Passed, 5 weeks |
| 911 | 3 | 120 | 30 | Passed, 5 weeks |
| 912 | 3 | 120 | 30 | passed, 5 weeks |
| 913 | 3 | 120 | 30 | Passed, 2 weeks |
| 906 | 3 | 140 | 30 | Failed, 1 week |
| 907 | 3 | 140 | 30 | Failed, 1 week |
| 908 | 3 | 140 | 30 | Failed, 1 week |
| 909 | 3 | 140 | 30 | Failed, 2 weeks |
| 903 | 3 | 160 | 30 | Failed, 3 days |
| 904 | 3 | 160 | 30 | Failed, 3 days |
| 905 | 3 | 160 | 30 | Failed, 3 days |

*Evaluated critically per MIL-C-5541A for a Class 1 coating (required minimum salt-spray life of 14 days).
**A few pits, barely detectable with the unaided eye, were found after 2 weeks in salt spray. Upon re-exposure to salt-spray for another week, no further change in appearance was observed.

The invention may be embodied in other forms without departing from the spirit or essential characteristics thereof. The present embodiments are, therefore, to be considered in all respects as illustrative and not restrictive, the scope of the invention being indicated by the appended claims rather than by the foregoing description, and all changes which come within the meaning and range of equivalency of the claims are therefore intended to be embraced therein.

What we claim is as follows:

1. A method for treating aluminum to enhance corrosion resistance of its surface, which comprises:

a. deoxidizing the aluminum surface with a non-chromated deoxidizer;

b. exposing the aluminum surface to a solution containing the nitrite ion and having a pH below 5;

c. coating the aluminum surface with a chemical conversion solution; and d. drying the chemical conversion coated aluminum surface with drying means.

2. The method of claim 1 wherein said non-chromated deoxidizer is a nitric acid solution with a concentration of nitric acid of at least 10% by volume of a 100% solution.

3. The method of claim 1 wherein said deoxidizing means contains a sufficient concentration of fluoride ion to etch the aluminum surface at a rate of at least 0.05 mil/hr.

4. The method of claim 1 wherein the pH of said nitrite solution is 3 or less.

5. The method of claim 1 wherein the drying is performed at a temperature between 110° F. and 130° F.

6. The method of claim 1 wherein the nitrite ion in said solution is substantially contributed by sodium nitrite.

7. The method of claim 1 wherein the nitrite ion in said solution is substantially contributed by potassium nitrite.

8. The method of claim 1 wherein the nitrite ion in said solution is substantially contributed by a mixture of sodium and potassium nitrite.

9. In a process of treating the surface of aluminum metal to enhance corrosion resistance which includes deoxidizing the surface with a deoxidizer and conversion coating the aluminum surface, the improvement of exposing the aluminum surface to a nitrite solution with a pH below 5 after deoxidizing the aluminum with said deoxidizer and before said conversion coating of the aluminum surface.

10. The method of claim 1 wherein the non-chromated deoxidizer is nitric acid in a concentration of 15 to 25 percent by volume based on 100 percent nitric acid.

11. The method of claim 1 wherein the non-chromated deoxidizer is nitric acid in a concentration of 30 percent to 50 percent based on commercial grade nitric acid.

* * * * *